US005770808A

United States Patent [19]

Yokoyama

[11] Patent Number: 5,770,808

[45] Date of Patent: Jun. 23, 1998

[54] PRODUCT QUALITY DETERMINING METHODS FOR DIE CAST MACHINES

[75] Inventor: Hiroshi Yokoyama, Kanagawa-ken, Japan

[73] Assignee: Toshiba Kikai Kabushiki Kaisha, Tokyo, Japan

[21] Appl. No.: 822,796

[22] Filed: Mar. 24, 1997

[30] Foreign Application Priority Data

Mar. 29, 1996 [JP] Japan ..... 8-076866

[51] Int. Cl.[6] ..... G01N 19/00; B22C 19/04

[52] U.S. Cl. ..... 73/865.9; 340/679; 164/154.1

[58] Field of Search ..... 73/865.9; 173/20; 340/679, 680; 164/151, 151.1, 151.2, 151.4, 152, 154.1, 154.2, 154.6, 154.8

[56] References Cited

U.S. PATENT DOCUMENTS

| | | | |
|---|---|---|---|
| 3,552,215 | 1/1971 | Athey | 73/865.9 |
| 3,750,134 | 7/1973 | Weisend | 340/679 |
| 4,094,055 | 6/1978 | Morimoto | 164/154.2 |
| 4,339,749 | 7/1982 | Yamada | 340/679 |
| 4,874,032 | 10/1989 | Hatamura | 164/154.8 |
| 4,954,063 | 9/1990 | Iwamoto | 164/151 |
| 5,303,162 | 4/1994 | Yoon | 173/20 |
| 5,363,709 | 11/1994 | Ives et al. | 73/865.9 |

FOREIGN PATENT DOCUMENTS

| | | |
|---|---|---|
| 55-48628 | 4/1980 | Japan . |
| 2-223639 | 9/1990 | Japan . |
| 6-4789 | 1/1994 | Japan . |

*Primary Examiner*—George M. Dombroske
*Assistant Examiner*—Paul D. Amrozowicz
*Attorney, Agent, or Firm*—McDonnell Boehnen Hulbert & Berghoff

[57] ABSTRACT

In a product quality determining method for dies cast machines, injection and casting conditions such as injection speeds, speed change-over positions, high speed interval, pressure raising time, casting pressure, and die clamping force by means of measuring means for each shot in actual casting process of the dies cast machine automatically measured. A measured value relating to the injection and casting condition of a shot as a reference value for determining a product quality when a good product button is operated by operators is set. A product quality determining range by determining upper limit value and a lower limit value of a predetermined allowable width with respect to the reference value is set. Whether or not the measured value of the injection and casting condition is within the product quality determining range by means of an arithmetic operation means is determined.

9 Claims, 2 Drawing Sheets

FIG. 2

| PRODUCT QUALITY CONDITION SETTING | MODEL NAME : A-111 | PRODUCT NAME · TRANSMISSION CASE | NO UPDATE | YEAR, MONTH, DAY |
|---|---|---|---|---|
| | MODE : NEUTRAL FD : PRN : | | | |

| ITEM | | CYCLE TIME S | DIE CLAMPING FORCE AVERAGE % | LOW SPEED m/s | HIGH SPEED m/s | PRESSURE RAISING TIME ms | CASTING PRESSURE kgf/cm$^2$ |
|---|---|---|---|---|---|---|---|
| GOOD PRODUCT VALUE | | 58.2 | 88 | 0.345 | 2.049 | 81 | 569 |
| ALARM VALUE | UPPER LIMIT | 70.0 | 100 | 0.500 | 2.500 | 100 | 800 |
| | LOWER LIMIT | 40.0 | 70 | 0.200 | 1.500 | 50 | 500 |
| OUTPUT | | OFF | CYCLE STOP | BUZZER | BUZZER | OFF | OFF |

| ITEM | | LOW SPEED ACCELERA-TION ms | HIGH SPEED ACCELERA-TION ms | HIGH SPEED START mm | AMOUNT OF MOLTEN METAL kgf | BISCUIT THICKNESS cm | HIGH SPEED INTERVAL cm |
|---|---|---|---|---|---|---|---|
| GOOD PRODUCT VALUE | | 133 | 17 | 322.4 | 1.82 | 19.0 | 99.6 |
| ALARM VALUE | UPPER LIMIT | 150 | 30 | 330.0 | 2.00 | 25.0 | 110.0 |
| | LOWER LIMIT | 100 | 10 | 310.0 | 1.50 | 15.0 | 80.0 |
| OUTPUT | | OUTPUT 1 | OUTPUT 2 | OFF | BUZZER | DISPLAY | DISCHARGE |

CYCLE TIME UPPER LIMIT =

| INJECTION WAVEFORM | LINE DISPLAY | TREND DISPLAY | TEMPERATURE MONITOR | QUALITY CONDITION SETTING | ITEM SELECTION WINDOW | | PRINT |
|---|---|---|---|---|---|---|---|

PRODUCT QUALITY DETERMINING METHODS FOR DIE CAST MACHINES

BACKGROUND OF THE INVENTION

1. Field of the Invention

This invention relates to product quality determining method for die cast machines and more particularly to product quality determining method depending on injection and casting conditions.

2. Description of the Prior Art

In casting with die cast machines, reduction of a percentage of occurrence of faulty products and raising of yield rate are important points in views of production efficiency and economic performance.

Because complete methods for reducing the percentage of occurrence of faulty products or setting principles and methods for injection and casting conditions such as injection speeds, speed change-over positions, high speed interval, pressure raising time, casting pressure and die clamping force which generate no faulty products have not been yet established, currently the injection and casting conditions are adjusted by depending on experiences and sense of operators who see results (die cast products) of actual castings and determines that condition by the trial-and-error method to prevent any faulty product from being produced.

Defects found in faulty products resulting from improper injection and casting conditions such as injection speeds, speed change-over positions, high speed interval, pressure raising time, casting pressure and die clamping force includes improper spreading of molten metal, wrinkles, chalk mark, cold shut, cracks, blisters, sink mark, cavity, air tight failure and the like.

In the above-described setting of the injection and casting condition by the trial-and-error method, the injection and casting condition of a shot in which faulty products are produced is distinguished from that of a shot in which good products are obtained and an injection and casting condition of a shot in which good products are obtained is set as an appropriate condition. However, if the operation is continued even if an actual injection and casting condition deviates from the appropriate condition due to disturbance or the like reason in usual operation (product production operation) of the die cast machine, the percentage of occurrence of a faulty product increases.

Further, conventionally, an injection and casting condition of a shot for obtaining good products has not been determined quantitatively. Thus, setting of injection and casting condition for following castings with similar dies had to be achieved depending on experiences and sense of operators from a first step.

SUMMARY OF THE INVENTION

Accordingly, an object of the present invention is to solve the above problem and provide product quality determining method for die cast machines which automatically estimates and determines a shot having a high possibility that a faulty product may occur due to a reason relating to injection and casting condition without a necessity of difficult setting and operation by operators, automatically notifies that a condition in which a faulty product is likely to occur has been reached, can automatically stop the operation of a die cast machine and can find out an injection and casting condition of a shot in which good products are obtained quantitatively to obtain a reference value for following castings with similar dies.

To this aim, there is provided a product quality determining method for die cast machines, the method comprising the steps of: automatically measuring injection and casting conditions such as injection speeds, speed change-over positions, high speed interval, pressure raising time, casting pressure, and die clamping force by means of measuring means for each shot in actual casting process of the dies cast machine; setting a measured value relating to the injection and casting condition of a shot as a reference value for determining a product quality when a good product button is operated by operators; setting a product quality determining range by determining upper limit value and a lower limit value of a predetermined allowable width with respect to the reference value; and determining whether or not the measured value of the injection and casting condition is within the product quality determining range by means of an arithmetic operation means.

According to the product quality determining method of the present invention, injection and casting conditions such as injection speeds, speed change-over positions, high speed interval, pressure raising time, casting pressure, die clamping force or the like are automatically measured by measuring means for each shot, an injection and casting condition provided when a good product button is operated by operators is automatically set as a reference value for determining the injection and casting condition, a good product determining range is set by providing a upper limit value and a lower limit value of a predetermined allowable width with respect to this reference value and then whether or not a measured value of the injection and casting condition is within the good product determining range is determined to achieve the determination of product quality.

According to another aspect of the present invention, there is provided a product quality determining method for die cast machines further comprising a step of making an alarm output when the measured value is out of the product quality determining range.

According to the above product quality determining method, if a measured value is out of the product quality determining range or if it is estimated that a faulty product occurs, an alarm output is made so as to notify operators of that event.

According to still another aspect of the present invention, there is provided a product quality determining method for die cast machines further comprising a step of making output for halting the machine such as product discharge halt and next shot halt when the measured value is out of the product quality determining range.

According to the above product quality determining method, if the measured value is out of the product quality determining range or if it is estimated that a faulty product occurs, the output for halting the machine such as product discharge halt and next shot halt is made.

According to a further aspect of the present invention, there is provided a product quality determining method for die cast machines wherein the upper limit value and the lower limit value can be set individually by users for each of the casting conditions.

According to the above product quality determining method, the range width of the product quality determining range can be set by users to an appropriate value in which user's know-how is effectively used.

According to the above product quality determining method, the reference value for determining the product quality is displayed on a screen or recorded as a good product value.

According to the product quality determining method, the reference value for determining the product quality which is automatically set when the good product button is operated is displayed on a screen or recorded as the good product value and can be used as a reference value for following similar castings, thereby contributing to accumulation of user's know-how.

The nature, principle and utility of the invention will become more apparent from the following detailed description when read in conjunction with the accompanying drawings.

BRIEF DESCRIPTION OF THE DRAWINGS

In the accompanying drawings:

FIG.2 is an explanatory diagram showing an example of display on screen of product quality condition setting mode according to the product quality determining method of the present invention.

DESCRIPTION OF THE PREFERRED EMBODIMENTS

Figure 1:
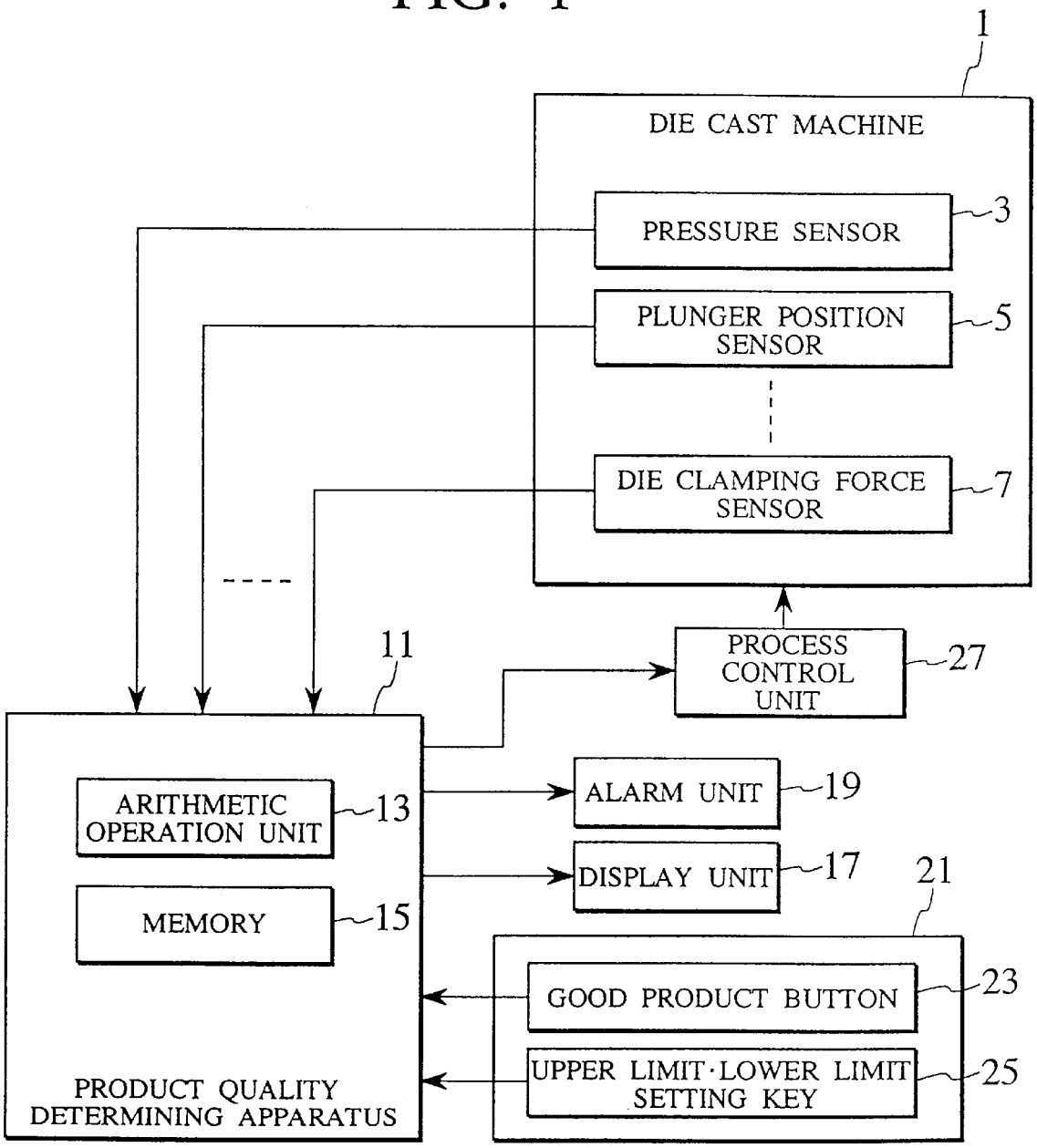
FIG. 1 is a block diagram showing an embodiment of a die cast machine and product quality determining apparatus to which product quality determining method of the present invention is applied.

Hereinafter, embodiments of the present invention will be described in details with reference to the accompanying drawings.

FIG.1 shows an embodiment of a die cast machine and a product quality determining apparatus to which a product quality determining method of the present invention is applied. The die cast machine 1 comprises various measuring means such as pressure sensors 1, plunger position sensors 5 and die clamping force sensors 7. Measured values from the respective sensors are input into a product quality determining apparatus 11.

The product quality determining apparatus 11 may serve as a sequence control apparatus of the die cast machine 1 at the same time and comprises micro computers having an arithmetic operation unit 13 and memories 15. Display units 17 such as CRT and LCD, alarm units 19 and control panels 21 are connected to the product quality determining apparatus 11. The control panels 21 contain good product buttons 23 and upper limit/lower limit setting keys 25.

Process control units 27 for the die cast machine 1 such as PLC are connected to the product quality determining apparatus 11.

The product quality determining apparatus 11 fetches measured values obtained by the respective sensors such as the pressure sensors 3, the plunger position sensors 5 and the die clamping force sensors 7 in an actual casting process with the die cast machine 1 into the arithmetic operation unit 13 and obtains injection and casting conditions such as injection speeds (low speed, high speed), speed change-over positions, high speed interval, pressure raising time, casting pressure, and die clamping force directly in accordance with measured values or by arithmetic operation based on the measured values for each shot.

If the good product buttons 23 are operated by an operator after a certain shot, measured values obtained under injection and casting condition of that shot are stored in the memories 15 as reference values for determining a good product or a bad product. When product quality condition setting mode is selected, as shown in FIG.2, the reference values are displayed on screen in the display unit as good product values.

This good product value can be used as a reference value for following similar castings and is useful for accumulating user's know-how.

A good product determining range is set by determining a upper limit value and a lower limit value of a predetermined allowable width with respect to this reference value (good product value) in product quality condition setting mode. The upper limit value and the lower limit value can be set separately by users for each casting condition (item) by using the upper limit/lower limit setting key 25. As a result, users can set a range width of the good product determining range to appropriate values in which their know-hows are effectively used.

After that, the arithmetic operation unit 13 determines whether or not a measured value relating to injection and casting condition of each shot is within the good product determining range with respect to respective items. If the measured value is out of the good product determining range, the alarm unit 19 outputs an alarm to notify operators or output signals to the process control unit to halt product discharge or next shot (cycle). Receiving an instruction of halting products discharge, the process control unit 27 halts products discharge in the die cast machine 1, and if it receives an instruction of halting next shot, it halts next shot in the die cast machine 1.

The alarm output and the halt output can be set separately for each of the good product determining items and further the alarm output and the halt output can be set at the same time for one item.

The aforementioned alarm output can be made in a form of an alarm displayed on the display unit 17.

Consequently, a shot having a high possibility that a faulty product may be produced because of an injection and casting condition is automatically determined without requiring difficult user's setting procedures and operations and therefore, it is possible to automatically notify operators that a condition in which a faulty product is likely to be produced has been reached or automatically stop the operation of the die cast machine 1.

Although a particular embodiment of the present invention has been described in details above, it is apparent to those skilled in the art that the present invention is not restricted to this embodiment but various modifications thereof may be embodied within a spirit and scope of the present invention.

As easily understood from the above description, in the embodiment of the product quality determining method for die cast machines according to the present invention, the injection and casting conditions such as injection speeds, speed change-over positions, high speed interval, pressure raising time, casting pressure, and die clamping force are automatically measured by means of the measuring means for each shot, injection and casting conditions provided when the good product button is operated by operators are automatically set as each reference value for the determination, then the good product determining range is set by providing this reference value with a upper limit value and a lower limit value of a predetermined allowable width, and successively whether or not measured values of the injection and casting conditions are within the good product determining range to determine the product quality. Thus, difficult user's setting procedures and operations are not required, and it is possible to automatically notify that a condition in which a faulty product is likely to be produced because of an injection and casting condition thereby contributing to reduction of a percentage of occurrence of a faulty product.

Further, if a measured value is out of the good product determining range or if it is estimated that a faulty product occurs, the alarm output is made to notify operators of it so that the operators can know that event accurately by the alarm output, thereby contributing to reduction of a percentage of occurrence of a faulty product.

Still further, if a measured value is out of the good product determining range or if it is estimated that a faulty product occurs, a machine halt output such as product discharge halt and next shot halt is made. Thus, if it is estimated that a faulty product occurs, the die cast machine is automatically stopped so that continuing to operate the die cast machine with improper condition can be avoided, thereby making it possible to prevent the percentage of occurrence of a faulty product from increasing.

Further, the range width of the good product determining range can be set to appropriate values by users so that their know-hows are effectively used. As a result, it is possible to determine whether or not products are good as required depending on their demands.

Further, the reference value for determining product quality which is automatically set when the good product button is operated is displayed on the screen or recorded so that it can be used as a reference value for successive similar castings. Thus, a degree of dependence upon experience or sense of operators in setting injection and casting conditions in following castings with similar dies can be reduced so that setting of the injection and casting conditions can be achieved effectively thereby contributing to accumulation of user's know-how.

What is claimed is:

1. A product quality determining method for cast machines, said method comprising the steps of:

automatically measuring injection and casting conditions by means of measuring means for each shot in actual casting process of the die cast machine;

when a good product button is operated for a shot by an operator setting a measured value relating to the injection and casting condition of the shot as a reference value for determining a product quality;

setting a product quality determining range by determining an upper limit value and a lower limit value of a predetermined allowable width with respect to the reference value; and determining whether or not the measured value of the injection and casting condition is within said product quality determining range by means of an arithmetic operation means.

2. Product quality determining method for die cast machines as claimed in claim 1 further comprising a step of making an alarm output when said measured value is out of said product quality determining range.

3. A product quality determining method for die cast machines as claimed in claim 1 further comprising a step of halting product discharge or halting a next shot when said measured value is out of said product quality determining range.

4. A product quality determining method for die case machines as claimed in claim 1, wherein a plurality of injection and casting conditions and a plurality of measured values are respectively measured and set and said upper limit value and said lower limit value can be set individually by users for each of the injection and casting conditions.

5. A product quality determining method for die cast machines as claimed in claim 1, wherein said reference value for determining the product quality is displayed on a screen or recorded as a good product value.

6. A product quality determining method for die cast machines as claimed in claim 2, wherein said reference value for determining the product quality is displayed on screen or recorded as a good product value.

7. A product quality determining method die cast machines as claimed in claim 3, wherein said reference value for determining the product quality is displayed on screen or recorded as a good product value.

8. A product quality determining method for die cast machines as claimed in claim 4, wherein the plurality of injection and casting conditions are injection speeds, speed change-over positions, high speed interval, pressure raising time, casting pressure, and die clamping force.

9. A product quality determining method for die cast machines as claimed in claim 4, wherein when one of said plurality of measured values is out of said product quality determining range, according to the one measured value, alarm output is made or product discharge or a next shot is halted.

* * * * *